US005234137A

United States Patent [19]

Meuresch et al.

[11] Patent Number: 5,234,137

[45] Date of Patent: Aug. 10, 1993

[54] DISC FOR MOUNTING THE VALVE OF A SPRAY CAN

[75] Inventors: Herbert Meuresch, Taunusstein; Martin Becker, Niedernhausen; Louis Pericard, Hattersheim, all of Fed. Rep. of Germany

[73] Assignee: Precision Valve Corporation, Yonkers, N.Y.

[21] Appl. No.: 999,196

[22] Filed: Dec. 28, 1992

Related U.S. Application Data

[63] Continuation of Ser. No. 809,238, Dec. 19, 1991, abandoned, which is a continuation of Ser. No. 739,717, Jul. 29, 1991, abandoned, which is a continuation of Ser. No. 639,754, Jan. 11, 1991, abandoned, which is a continuation of Ser. No. 527,652, May 21, 1990, abandoned, which is a continuation of Ser. No. 418,891, Sep. 29, 1989, abandoned, which is a continuation of Ser. No. 312,415, Feb. 17, 1989, abandoned, which is a continuation of Ser. No. 165,103, Mar. 16, 1988, abandoned.

[30] Foreign Application Priority Data

Jun. 24, 1987 [DE] Fed. Rep. of Germany ..... 3621817

[51] Int. Cl.[5] ..... B65D 83/00

[52] U.S. Cl. ..... 222/402.1; 53/470; 413/43

[58] Field of Search ..... 222/402.1; 413/7, 42, 413/43, 44, 58-62; 53/470

[56] References Cited

U.S. PATENT DOCUMENTS 4,111,339 9/1978 Schmidt .

4,150,522 4/1979 Burger ..... 222/402.1 X

FOREIGN PATENT DOCUMENTS 23022 3/1984 Australia .
46004 1/1986 Australia .
59019 11/1986 Australia .
1221946 5/1987 Canada .
1803507 5/1970 Fed. Rep. of Germany .
2088293 1/1972 France .
8606701 11/1986 PCT Int'l Appl. ..... 222/402.1
2145775 4/1985 United Kingdom ..... 222/402.1

*Primary Examiner*—Gregory L. Huson
*Attorney, Agent, or Firm*—Davis Hoxie Faithfull & Hapgood

[57] ABSTRACT

A disc for mounting a valve onto a spray can which is capable of engaging a standard-sized protective cap such that the cap fills all the space between the disc and the top of the spray can regardless of variations in the thickness of the disc or the seal. The disc has a central body portion and an annular groove disposed at the periphery of the central body portion. The bead of the spray can sits within the annular groove. A seal is positioned between the annular groove and the bead. A spacer is positioned in the annular groove such that the spacial relationship between the bead and the annular groove is predetermined, i.e., the distance between the annular groove and the top of the can is a predetermined distance. Consequently, a standard-sized protective cap can be used for spray cans in which the seal thickness and disc thickness vary, wherein the cap fits snugly on the disc and fills the entire space between the disc and the top of the can.

11 Claims, 4 Drawing Sheets

DISC FOR MOUNTING THE VALVE OF A SPRAY CAN

CROSS REFERENCE TO RELATED APPLICATION

This application is a continuation of application Ser. No. 07/809,238, filed Dec. 17, 1991, now abandoned; which is a continuation of Ser. No. 07/739,717, filed Jul. 29, 1991, now abandoned; which is a continuation of application Ser. No. 07/639,754, filed Jan. 11, 1991, now abandoned; which is a continuation of Ser. No. 07/527,652, filed May 21, 1990, now abandoned; which is a continuation of application Ser. No. 07/418,891, filed Sep. 29, 1989, now abandoned; which is a continuation of application Ser. No. 07/312,415, filed Feb. 17, 1989, now abandoned; which is a continuation of application Ser. No. 07/165,103, filed Mar. 16, 1988, now abandoned.

The invention relates to a disc for mounting the valve of a spray can, comprising a central body portion for receiving the valve and an annular groove which surrounds the central body portion and which is formed by bending the outer edge of the disc and in which groove a seal is disposed. The annular groove serves to receive the edge of the opening of the spray can, to which edge the disc is clinched.

In a known disc 1 of the kind shown in FIG. 1, after a seal 3 has been fitted into an annular groove 4 of the disc 1 and after the disc 1 has been fitted onto a bead 5 of the opening of a spray can, with the annular groove 4 of the disc 1 engaging the bead 5 of the opening, the central body portion 2 of disc 1 is expanded by an operation referred to as 'clinching' radially outwardly under the bead 5 of the opening of the spray can 6, to a clinching diameter $D_c$, in order to connect the disc 1 sealingly to the spray can 6. In that arrangement the spreading head of the clinching tool bears against an outside surface 7 of a wall 8 which forms the annular groove 4, the wall acting as a support means for the tool. The tool projects into the body portion 2 as far as a predetermined clinching height $H_c$. The cans 6 are generally composed of cylindrical side walls. A bridge section 18 extends from the side walls to the bead 5.

While the clinching diameter $D_c$ is kept comparatively precise, for example at about 27.0 mm, the clinching height $H_c$ must be changed from one situation to another in such a way that it is adapted to the following parameters:

a) the spreading head radius $R_c$ b) the rolling radius $R_b$ of the bead c) the thickness $T_g$ of the seal 3, and d) the material thickness $T_m$ of the disc 1.

Those parameters must be borne in mind by the filler of the spray can 6 who also connects the disc 1 to the spray can 6 and who for that purpose must suitably adjust the clinching tool.

If the same clinching tool and the same spray cans are always used, it is only necessary to take into consideration the thickness $T_g$ of the seal and the thickness $T_m$ of the disc. However, they may differ greatly depending on the nature of the seal and the disc material. Thus in practice the thickness $T_g$ of the seal may show the following ranges of fluctuations:

rubber ring seals: $T_g$=1.0–1.2 mm injection seals: $T_g$=0.6–0.75 mm film seals: $T_g$=0.2–0.4 mm.

The thickness $T_m$ of the disc material may be for example of the following values:

aluminum disc: $T_m$=0.42 mm steel sheet disc: $T_m$=0.28 mm.

With uniform radii $R_c$ and $R_b$, the clinching height $H_c$ would therefore have to be set approximately as follows:

| | Steel sheet disc | Al-disc |
|---|---|---|
| rubber ring seal: | $H_c$ = 4.9 . . . 5.1 mm | 5.05 . . . 5.25 mm |
| injection seal: | $H_c$ = 4.5 . . . 4.65 mm | 4.65 . . . 4.80 mm |
| film seal: | $H_c$ = 4.1 . . . 4.3 mm | 4.25 . . . 4.45 mm. |

Depending on the disc-seal combination which is being used, the filler is therefore required in a practical situation to possibly vary the clinching height $H_c$ in a range of up to 1.35 mm (=about 30%).

Closely related to the above-indicated variable parameters which serve for reliably sealing off the compressed gas pack are the dimensions of the wall 8 that forms a disc flange 9 and a lower portion 10 of a protective cap 11 or an actuating fitment which latches to the disc flange 9.

If, in order to reduce the stock requirements, there is a wish to use protective caps 11 which as far as possible are of only one size, the height $H_u$ of the lower portion 10 of the cap must be so selected that it fits even into the smallest space of the height $D_s$ between the outer edge of the flange 9 and the bridge 18 of the spray can 6, as the height $D_s$ alters in dependence on the thickness $T_m$ of the disc material and the thickness $T_g$ of the seal 3. There are therefore situations in which the lower portion 10 does not completely fill up the space $D_s$ between the outer edge of the flange 9 and the bridge 18 of the spray can 6. That is undesirable for visual reasons.

If the latter situation is to be avoided, it is necessary to stock protective caps 11 of different heights $H_u$.

Two options may be used here:

a) constant flange height $H_s$.

Although this is extremely desirable, it can give rise to difficulties as that can require alterations in the height $H_u$ of the lower portion 10 of the protective cap 11.

b) Constant height $D_s$ of the space between the disc flange 9 and the top side of the can.

This would also be extremely desirable but it can also give rise to difficulty in that the height $H_s$ of the flange must be of different dimensions in dependence on the thicknesses of the seal and the disc material.

If therefore all parts are to be correctly matched together, the filler is obliged to stock parts of different dimensions, which is an expensive business.

Both in case a) and in case b) the possible range of 1.35 mm over which the clinching height can vary is much too great for it to be easily compensated by suitably selecting a protective cap or an actuating fitment.

Another difficulty arises due to the fact that skilled personnel must be available to arrive at the correct choice, quite apart from the additional amount of time involved as a result. Both factors increase the packaging costs.

Then, any change in the clinching height $H_c$ requires the clinching tool to be re-set. That can be very time-consuming, particularly if the filling installation has a plurality of clinching heads. Conversion of the clinching tools possibly takes up to four hours, during which period the installation is out of operation.

The invention is based on the object of providing a disc which, irrespective of alterations in the thickness of the seal and the disc, reduces the stock-keeping expenditure on the part of the filler and the stoppage times of the filling installation.

In accordance with the invention, that object is attained in that the annular groove is provided with a spacer means, which bears against the seal and which is shaped in accordance with the material thicknesses of the disc and the seal. The annular groove is formed by an inner edge and an outer edge connected by an arch. The spacer means sets the distance from the outside surface 7 of the flange 9 to the top of the bead 5 at a predetermined distance in light of the thicknesses of the disc and the seal.

In accord with this invention, the clinching height H and the height $H_s$ of the disc flange remain the same for all thicknesses of the disc material and the seal because different thicknesses of disc material and seal are compensated for by a suitable configuration of the spacer means. The filler therefore does not need to deal with any conversion of the clinching tool, irrespective of the thickness of the disc material and the seal. Likewise he can use protective caps or actuating fitments in which the height $H_u$ of the lower portion 10 is constant and equal to the height $D_s$ of the space between the outer edge of the flange and the bridge, thereby also reducing stock keeping expenditure.

The spacer means preferably comprises at least one projection in the annular groove. Such a projection may be produced in a simple manner in the operation of shaping the disc or in the subsequent operation of mounting the disc, by the valve supplier.

Thus, the projection may be formed by a depression in the outside surface of the flange 9 of the disc 1, which forms the annular groove 4. The depression is simply pressed into the disc material, in the manner of a bead or corrugation.

The spacer means may be cup-like depressions or radial ribs in the arch of the annular groove 4, which at the same time provide for a stiffening of the disc material in the annular groove.

Those ribs may also be easily formed by radial depressions in the outside surface of the flange of the disc, which forms the annular groove 4.

Alternatively, the spacer means may comprise a projection extending in the peripheral direction of the annular groove 4 in the arch. Even if such a projection is formed as a continuously extending depression in the outside surface 7 of the flange 9 of the disc 1, which forms the annular groove 4, the projection does not have to be excessively deformed by the clinching pressure which is subsequently applied to the disc.

A further alternative may provide that the spacer means comprises a projection in the inner edge of the flange extending in the radial direction of the annular groove. This provides for contact over a large area in the region of the sealing surfaces through which passes the plane of the opening of the spray can, even when using what is known as a 'film seal' or an injected seal which extends over more than 180° of the rolled-over edge of the opening. At the same time the outer surface 7 of the flange 9 may further serve as an uninterrupted support surface for the clinching tool.

Another embodiment can provide that the spacer means is formed by indenting the inner edge of the annular groove. That design configuration also provides a large sealing surface area and an uninterrupted support at the outside surface 7 of the flange 9.

The invention and developments thereof are described in greater detail hereinafter with reference to the drawings which show preferred embodiments and in which.

Insofar as the parts shown in FIG. 2 are the same as those shown in FIG. 1, FIG. 2 employs the same reference numerals. Parts in FIG. 2 which differ from those shown in FIG. 1 are denoted by reference numerals which are increased by 20 in comparison with the reference numerals used in FIG. 1.

Figure 2:
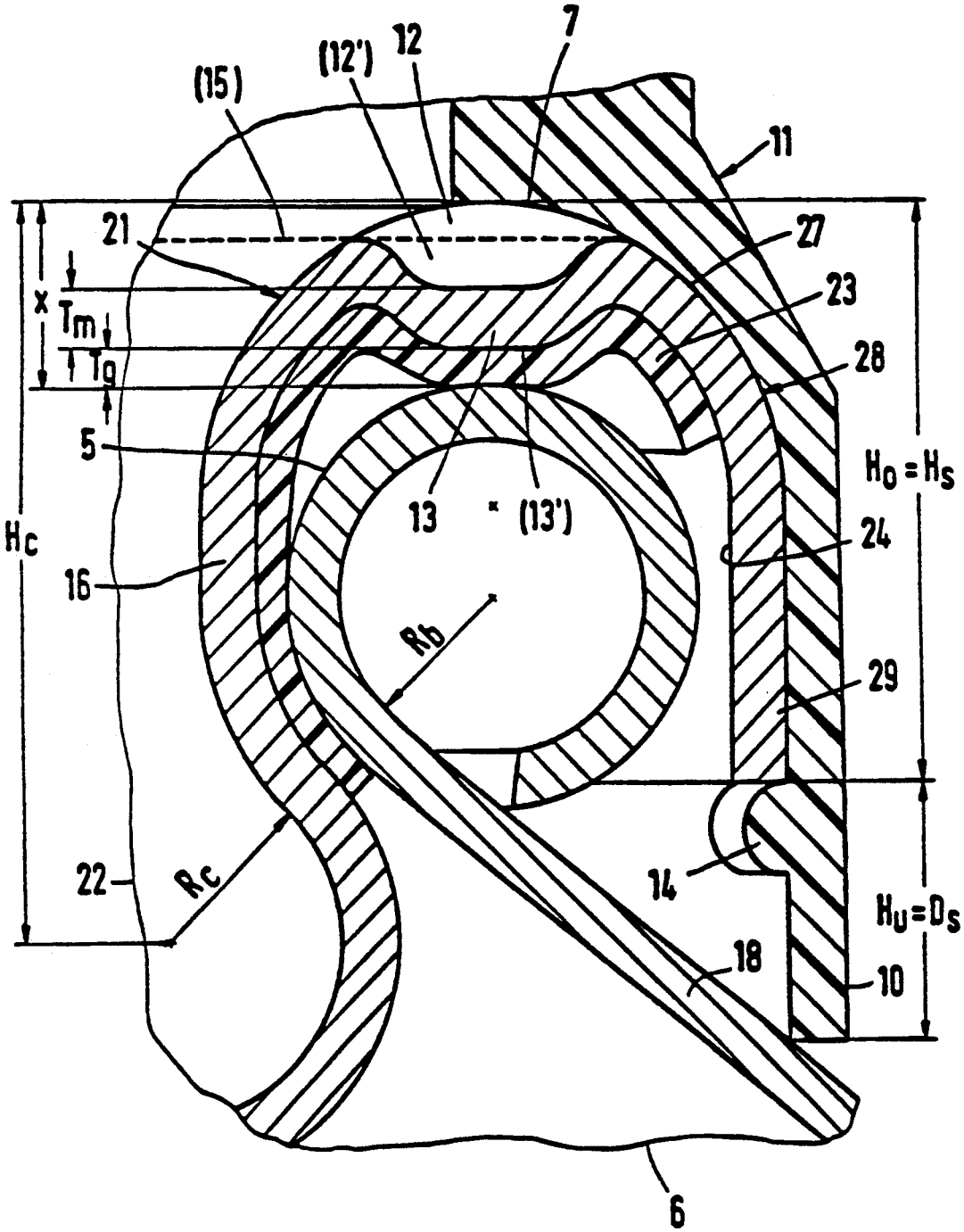
FIG. 2 is a view in axial section of a part of a spray can with protective cap fitted thereon and a first embodiment of a disc in accordance with the invention.

In the embodiment illustrated in FIG. 2, depressions 12 are impressed in the top of the wall 28 and appear as projections 13 at the arch of the annular groove 24. The depressions 12 and the projections 13 are distributed over the periphery of the disc 21 at preferably equal spacings. The depth of the depressions 12 or the height of the projections 13 is so selected that, in conjunction with the respective thickness $T_m$ of the disc material and the thickness $T_g$ of the seal material, they always give the same constant spacing x at which, with a fixedly predetermined clinching height $H_c$ and a fixedly predetermined flange height $H_s$, the spacing $D_s$ is always of the same value. Consequently, the height $H_u$ of the lower portion 10 of the protective cap 11 or a corresponding actuating fitment for the valve of the spray can 6 can always be constantly selected as being equal to the spacing $D_s$ so that the space between the outer edge of the flange 29 of the disc 21 and the bridge 18 of the spray can 6 is completely filled by the portion 10 in all situations in respect of seals 23 and disc materials of different thicknesses. The portion 10 has a radially inwardly projecting projection 14 which snaps under the outer edge of the flange 29.

In that arrangement, the height $H_o$ of the upper portion of the protective cap 11 is always of the same value which is equal to the flange height $H_s$ of the flange 29. There is therefore no need to stock protective caps 11 with different dimensions in respect of $H_o$ and $H_u$.

Likewise, there is no need for the clinching tool to be set to different clinching heights $H_c$, on the part of the filler.

Instead of the depressions 12 which are spaced apart in the peripheral direction of the disc 21, it is also possible to provide a depression 12' which is continuous in the peripheral direction, giving a projection 13' which is correspondingly continuous in the peripheral direction of the disc, at the arch of the annular groove 21. When that depression 12' is provided, the upper edge of the disc, which is shown by the broken line 15 in that case, is at a somewhat lower position. However the protective cap 11 still remains in the same position as it still bears against the outside surface 27 of the wall 28. As the clinching tool is usually supported not only against the top of the outside surface 27, but also on the somewhat further outwardly disposed surface 27, the clinching depth $H_c$ also remains unaltered.

Figure 1:
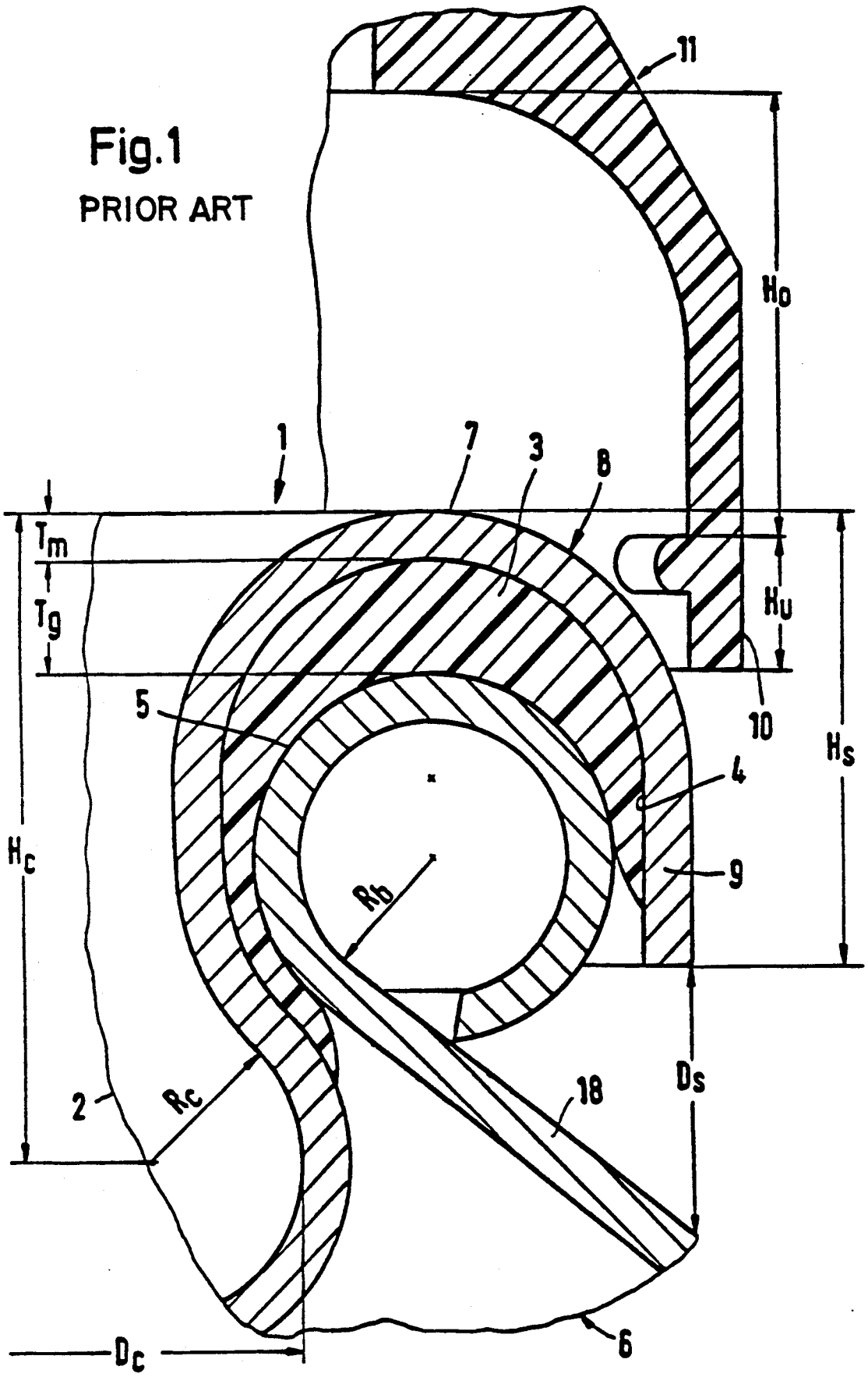
Fig.1 PRIOR ART
FIG. 1 is a view in axial section of a part of a known spray can with protective cap prior to the protective cap being fitted thereon.

The seal 23 is a film seal, that is to say a portion which is cut from a tube and which is pushed over the middle body portion 22 of the disc 21 into the annular groove 24 so that it bears not just against the floor or bottom of the annular groove 24 but also against the inner edge 16. Consequently, there are still large sealing surface areas in the region of the inner edge 16. It is also however possible to use an injected seal 3, as shown in FIG. 1.

Furthermore, instead of the film seal 23, it is possible to use a seal in the form of an annular disc which only bears between the projection 13' and the top of the bead 5 of the opening. Although in that case there is a somewhat smaller sealing surface area between the disc 21 and the bead 5 than when using the seal 23 or the seal 3, the sealing surface area is nonetheless still of sufficient size, by virtue of the peripherally extending projection 13'.

Figure 3:
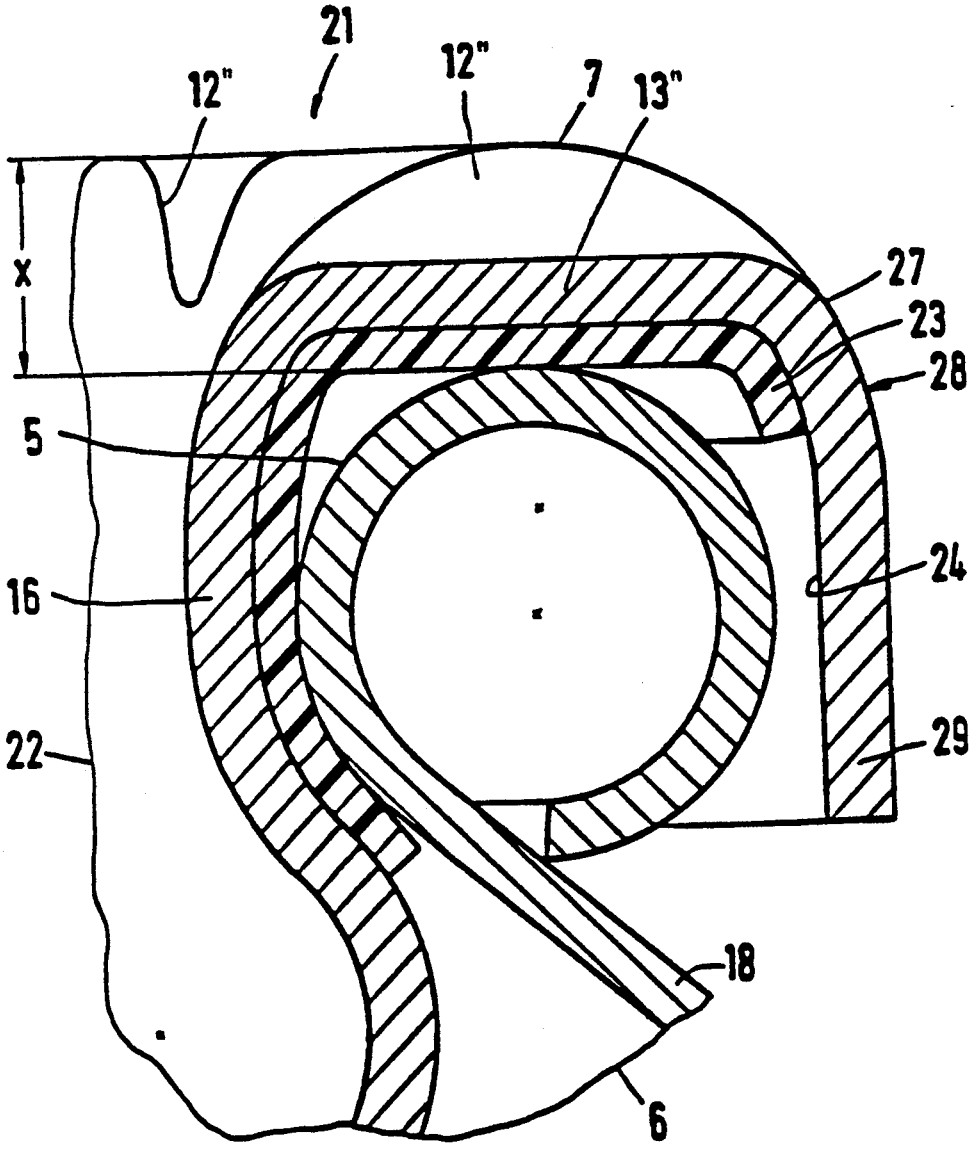
FIG. 3 is a view in axial section of a part of a spray can with a second embodiment of a disc according to the invention, the protective cap being omitted for the sake of simplicity of the drawing.

The embodiment shown in FIG. 3 differs from that shown in FIG. 2 only in that instead of the substantially frustoconical or conical depressions 12, they are in the form of radial grooves 12'' in the arch of the wall 28 with corresponding radial ribs 13'' in the annular groove 24. The grooves 12'' and ribs 13'' provide at the same time for stiffening the arch of the annular groove 24. The dimensions are the same as those of the embodiment shown in FIG. 2 while the protective cap 11 has been omitted for the sake of simplicity of the drawing.

Figure 4:
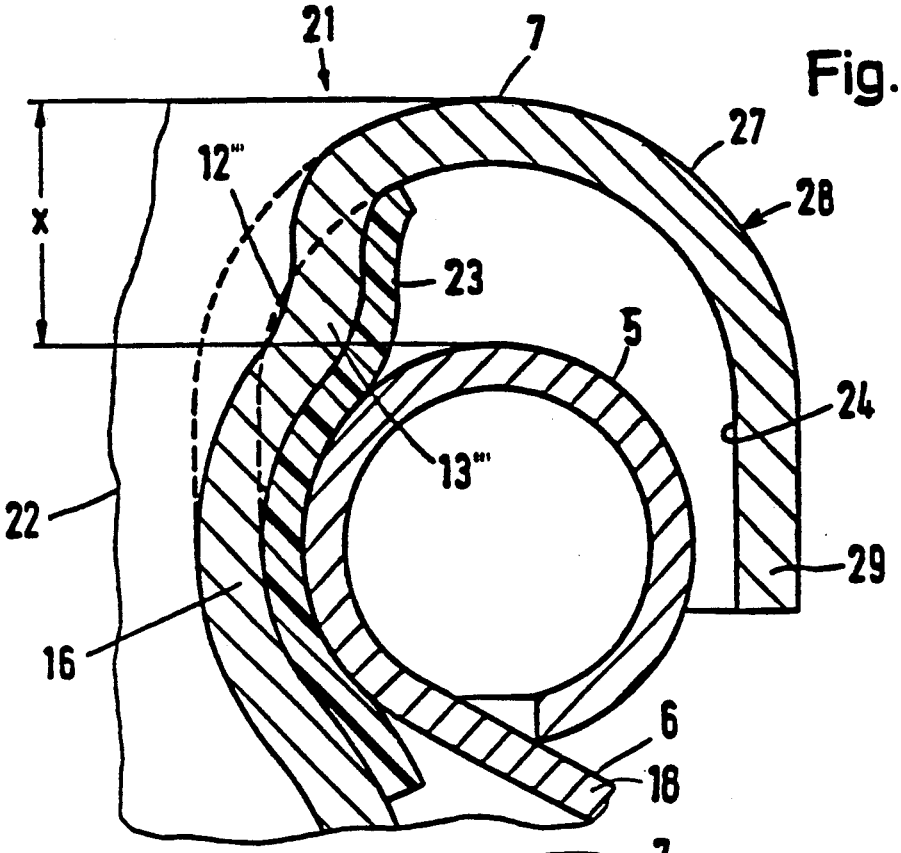
FIG. 4 is a view in axial section of a part of a spray can with a third embodiment of a disc according to the invention, the protective cap being omitted for the sake of simplicity of the drawing.

The embodiment shown in FIG. 4 differs from that shown in FIG. 2 only in that, instead of the depressions 12 and projections 13, it has a depression 12''' and a projection 13''' which extend at the inner edge 16 of the annular groove. The projection 13''' protrudes in the peripheral direction above the lower half of the bead 5 of the opening of the spray can 6 so that the outside surface 7 of the arch still retains its usual form. The nondeformed contour of the wall 28 is shown by broken lines in the region of the depression 12''' and the projection 13'''.

Figure 5:
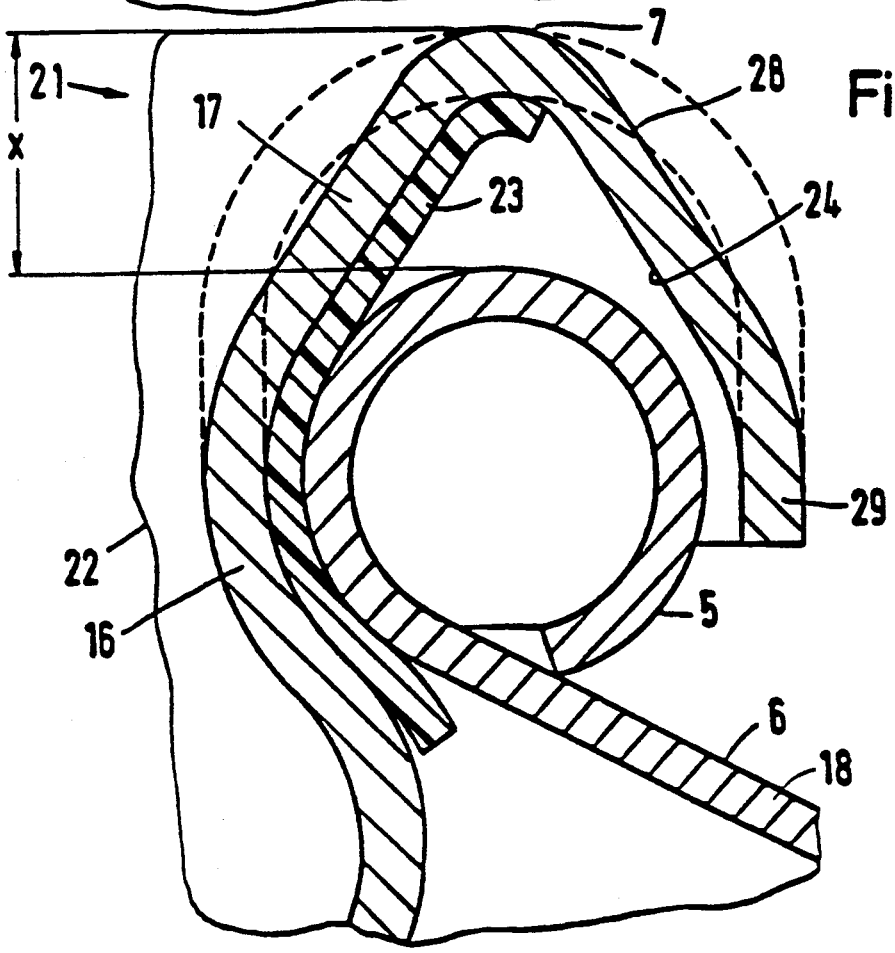
FIG. 5 is a view in axial section of a part of a spray can with a fourth embodiment of a disc according to the invention, the protective cap being omitted for the sake of simplicity of the drawing.

The embodiment shown in FIG. 5 differs from that shown in FIG. 2 only in that the cross-sectional contour of the wall 28 is substantially V-shaped above the lower half of the bead 5 so that the inner edge 16 of the annular groove 24 forms an inclined wall 17 which serves as a spacer means.

We claim:

1. A disc for mounting a valve onto a spray can having a side wall and a bridge section attached to the top of the side wall, the bridge section extending inwardly to form an opening where the bridge section is bent back to form a bead, the disc comprising:

a central body portion;

a flange having an outer edge with a bottom mounted at the periphery of the central body portion which flange is curved concave down to form an annular groove wherein the annular groove is capable of receiving the bead;

an outside surface disposed at the top of the flange, the flange having a flange height defined as the distance between the outside surface and the bottom of the outer edge; and an essentially permanent spacer means disposed within the annular groove for spacing the bead in a predetermined spatial relationship with the annular groove when the disc is clinched onto the can such that the distance from the bottom of the outer edge to the bridge is a first predetermined distance and the flange height is a second predetermined distance.

2. The disc according to claim 1 wherein the spacer means comprises at least one projection in the annular groove.

3. The disc according to claim 2 wherein the projection is formed by a depression in the outside surface of the flange of the disc.

4. The disc according to claim 1 wherein the spacer means comprises radial ribs at an arch of the annular groove.

5. The disc according to claim 4 wherein the ribs are formed by radial depressions in the flange of the disc.

6. The disc according to claim 1 wherein the spacer means comprises a projection extending in the peripheral direction of the annular groove at an arch.

7. The disc according to claim 1 wherein the spacer means comprises a projection extending in the peripheral direction of the annular groove in an inner edge.

8. The disc according to claim 1 wherein the spacer means is formed by an inclined wall portion of the annular groove.

9. A spray can assembly capable of supporting a protective cap such that no gap exists between the cap and the spray can comprising:

a spray can having a side wall with a top side, a bridge section attached to the top of the side all extending inwardly to form an opening, and a bead disposed about the opening;

a disc clinched to the spray can for mounting a valve onto the spray can having:

a central body portion;

a flange with an outside surface and an outer edge having a bottom mounted at the periphery of the central body portion which flange is curved concave down to form an annular groove wherein the annular groove is attached to the bead and the flange having a flange height defined as the distance between the outer surface and the bottom of the outer edge;

a seal disposed between the annular groove and the bead; and a means disposed in the annular groove for permanently spacing the bead in a predetermined spatial relationship with the annular groove based on the thickness of the seal and the thickness of the flange such that, when the disc is clinched onto the spray can, the distance from the bottom of the outer edge to the bridge is a first predetermined distance and the flange height is a second predetermined distance.

10. The spray can assembly of claim 9 wherein the spacing means comprises a depression in the top of the flange.

11. The spray can assembly of claim 9 wherein the spacing means comprises at least one projection in the annular groove.

* * * * *